US011805895B2

(12) United States Patent
Tartal et al.

(10) Patent No.: US 11,805,895 B2
(45) **Date of Patent: *Nov. 7, 2023**

(54) PORTABLE AND FOLDABLE WORKSTATION APPARATUS

(71) Applicant: UNITED STATES POSTAL SERVICE, Washington, DC (US)

(72) Inventors: William A Tartal, Baltimore, MD (US); Joel L Dewnandan, Bladensburg, MD (US); Joram Shenhar, Fairfax, VA (US)

(73) Assignee: UNITED STATES POSTAL SERVICE, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/060,867

(22) Filed: Dec. 1, 2022

(65) Prior Publication Data

US 2023/0100359 A1 Mar. 30, 2023

Related U.S. Application Data

(63) Continuation of application No. 17/362,236, filed on Jun. 29, 2021, now Pat. No. 11,517,104.

(Continued)

(51) Int. Cl.

*A47B 3/08* (2006.01)
*A47B 21/02* (2006.01)

(Continued)

(52) U.S. Cl.

CPC ..... *A47B 3/08* (2013.01); *A47B 9/14* (2013.01); *A47B 21/02* (2013.01); *A47B 83/04* (2013.01);

(Continued)

(58) Field of Classification Search

CPC ..... A47B 3/08; A47B 9/14; A47B 2009/145; A47B 21/02; A47B 2200/0029

(Continued)

(56) References Cited

U.S. PATENT DOCUMENTS

D27,709 S 9/1897 Deal
1,905,396 A 4/1933 Michelet (Continued)

FOREIGN PATENT DOCUMENTS

CN 204273631 U * 4/2015 ..... A47B 13/003

OTHER PUBLICATIONS

Office Action issued in U.S. Appl. No. 29/740,201 dated Dec. 22, 2022, 15 pages.

(Continued)

*Primary Examiner* — Jose V Chen
(74) *Attorney, Agent, or Firm* — MH2 TECHNOLOGY LAW GROUP, LLP

(57) ABSTRACT

A portable workstation apparatus includes: a pair of collapsible legs; and a work portion that is attached in a removable manner to the pair of collapsible lags via a pair of brackets. Each leg of the pair of collapsible legs includes: a frame; an extension connected to a first end of the frame; a lower post housed within a sleeve; an upper post; a hinge connecting the lower post and the upper post; a first brace connecting the extension to the sleeve; and a plurality of holes on an exterior face of the lower post or the upper post. Each leg is configured to collapse by folding the upper post towards the lower post via the hinge and rotating the extension toward the lower post.

20 Claims, 14 Drawing Sheets

Related U.S. Application Data

(60) Provisional application No. 63/047,116, filed on Jul. 1, 2020.

(51) Int. Cl.
*A47B 83/04* (2006.01)
*A47B 9/14* (2006.01)

(52) U.S. Cl.
CPC . *A47B 2003/0824* (2013.01); *A47B 2009/145* (2013.01); *A47B 2200/004* (2013.01); *A47B 2200/0029* (2013.01)

(58) Field of Classification Search
USPC ..... 108/115, 116, 60, 61
See application file for complete search history.

(56) References Cited

U.S. PATENT DOCUMENTS

| | | | | |
|---|---|---|---|---|
| 2,889,055 | A | 6/1959 | Weller et al. | |
| D216,203 | S | 12/1969 | Hess | |
| D216,204 | S | 12/1969 | Hess | |
| 3,748,010 | A | 7/1973 | Garte | |
| D296,633 | S | 7/1988 | De Prins | |
| RE33,645 | E | 7/1991 | Coote | |
| D325,679 | S | 4/1992 | P'Mealy et al. | |
| 5,121,974 | A | 6/1992 | Monson | |
| 5,345,882 | A | 9/1994 | Yamada | |
| D372,138 | S | 7/1996 | Pasquale et al. | |
| D376,705 | S | 12/1996 | Stoddard et al. | |
| 5,644,993 | A | 7/1997 | Dohnalik | |
| D394,760 | S | 6/1998 | Tilley | |
| D405,625 | S | 2/1999 | Zaidman et al. | |
| D415,365 | S | 10/1999 | Nicklas | |
| 6,138,583 | A | 10/2000 | Mahone et al. | |
| D455,913 | S | 4/2002 | Shamie | |
| D466,717 | S | 12/2002 | Cho | |
| D469,979 | S | 2/2003 | Wang | |
| 6,540,093 | B1 | 4/2003 | Shumway | |
| 6,659,294 | B1 | 12/2003 | Simard | |
| 6,688,634 | B2 * | 2/2004 | Noffsinger | B62B 3/02 280/47.35 |
| 6,692,091 | B2 | 2/2004 | Mulaw | |
| 6,786,162 | B1 * | 9/2004 | Volkmer | A47B 5/06 108/115 |
| 7,086,632 | B2 * | 8/2006 | Hsieh | G10H 1/32 248/163.1 |
| 7,341,006 | B2 | 3/2008 | Hernandez | |
| 7,604,027 | B2 | 10/2009 | Thatcher | |
| D616,230 | S | 5/2010 | Leeds et al. | |
| D643,229 | S | 8/2011 | Rosenfeld | |
| 8,015,928 | B2 | 9/2011 | Chen | |
| D673,391 | S | 1/2013 | Whitehead | |
| 9,215,924 | B2 | 12/2015 | Seefeldt et al. | |
| 9,364,078 | B1 | 6/2016 | Lai et al. | |
| 9,532,647 | B2 | 1/2017 | Bedard et al. | |
| D799,246 | S | 10/2017 | Carlburg | |
| D799,252 | S | 10/2017 | Coretti, Jr. et al. | |
| 10,021,972 | B1 | 7/2018 | Robinson et al. | |
| 10,213,015 | B1 | 2/2019 | Anderson et al. | |
| D923,377 | S | 6/2021 | Mohan et al. | |
| 11,229,284 | B1 | 1/2022 | Trubacek et al. | |
| 11,517,104 | B2 * | 12/2022 | Tartal | A47B 83/04 |
| 2002/0084234 | A1 | 7/2002 | Chang | |
| 2003/0024444 | A1 | 2/2003 | Welch et al. | |
| 2003/0056699 | A1 * | 3/2003 | Malizia | A47C 9/10 108/115 |
| 2005/0274300 | A1 | 12/2005 | Chen | |
| 2007/0095257 | A1 * | 5/2007 | Hernandez | A47B 3/0815 108/115 |
| 2007/0256611 | A1 | 11/2007 | Huang | |
| 2007/0289506 | A1 * | 12/2007 | Branch | A47B 23/046 29/700 |
| 2008/0017083 | A1 | 1/2008 | VanNimwegen et al. | |
| 2009/0194007 | A1 | 8/2009 | Pearson | |
| 2009/0283021 | A1 | 11/2009 | Wong | |
| 2014/0331901 | A1 | 11/2014 | Seefeldt et al. | |
| 2015/0257527 | A1 | 9/2015 | Lai et al. | |
| 2016/0135589 | A1 | 5/2016 | Leng | |
| 2016/0309888 | A1 | 10/2016 | Krusin et al. | |
| 2022/0000256 | A1 | 1/2022 | Tartal et al. | |
| 2022/0095787 | A1 | 3/2022 | Leng | |

OTHER PUBLICATIONS

E-Z Sort Mailroom Furniture by biz2bizonline, first available: Unknown. Biz2bizonline.com [online], [site visited Apr. 29, 2022], Internet URL: https://www.biz2bizonline.com/safco/e-z_sort_mailroom_furniture.htm (Year: 2022), 1 page.

Huron 8 Compartment Steel File Organizer by Staples, first available: May 9, 2020. Staples.com [online], [site visited Apr. 29, 2022], Internet URL: https://www.staples.com/huron-8-compartment-steel-file-organizer-black-hasz0146/product_24431902 (Year: 2020), 1 page.

Mail Sorter Workstation by ULINE, first available: Unknown. Uline.com [online], [site visited Apr. 29, 2022], Internet URL: https://www.uline.com/Product/Detail/H-7149/Mailroom/Mail-Sorter-Workstation-50-Slots (Year: 2022), 1 page.

Office Action issued in U.S. Appl. No. 29/740,201 dated Jun. 17, 2022, 22 pages.

Office Action issued in U.S. Appl. No. 17/362,236 dated Apr. 19, 2022, 7 pages.

Notice of Allowance issued in U.S. Appl. No. 17/362,236 dated Aug. 12, 2022, 15 pages.

* cited by examiner

PORTABLE AND FOLDABLE WORKSTATION APPARATUS

CROSS-REFERENCE TO RELATED APPLICATIONS

This application is a continuation of U.S. patent application Ser. No. 17/362,236 filed on 29 Jun. 2021, which claims the benefit of, and priority to, U.S. Provisional Patent Application No. 63/047,116 filed on 1 Jul. 2020, both of which are hereby incorporated by reference in their entireties.

BACKGROUND

Office facilities may include desks, workstations, etc. to facilitate the performance of various office tasks. As one example, a postal facility may include specialized workstations to facilitate the sorting and processing of documents, such as mail pieces (e.g., envelopes and packages). Mail piece sorting and processing related tasks may need to be performed uninterrupted in order to ensure the timely delivery and performance of mail service, even in times in which postal facilities may be unavailable (e.g., due to hazardous weather conditions such as hurricanes, earthquakes, etc.).

SUMMARY

In one example aspect, a portable workstation apparatus includes: a pair of collapsible legs; and a work portion that is attached in a removable manner to the pair of collapsible lags via a pair of brackets. Each leg of the pair of collapsible legs includes: a frame; an extension connected to a first end of the frame; a lower post housed within a sleeve; an upper post; a hinge connecting the lower post and the upper post; a first brace connecting the extension to the sleeve; and a plurality of holes on an exterior face of the lower post or the upper post. Each leg is configured to collapse by folding the upper post towards the lower post via the hinge and rotating the extension toward the lower post.

In an example aspect, a collapsible leg includes: a frame; an extension connected to a frame; a lower post housed within a sleeve; an upper post; a hinge connecting the lower post and the upper post; and a plurality of holes on an exterior face of the lower post or the upper post. Each leg is configured to collapse by folding the upper post towards the lower post via the hinge, and rotating the extension toward the lower post.

In an example aspect, a hinge mechanism includes: a hinge body having a first end and a second end; a first member having an axis; a second member having an axis; a first pin connecting the first member to the hinge body such that the hinge body is rotatable relative to the first member; and a second pin connecting the second member to the hinge body such that the hinge body is rotatable relative to the second member. The first end of the hinge body extends into the first body, the second end of the hinge body extends into the second body, the axis of the first member and the axis of the second member are aligned when the hinge is in a first position, and the axis of the first member is parallel to the axis of the second member when the hinge is in a second position.

DETAILED DESCRIPTION

In certain situations, office facilities may be destroyed, uninhabitable, or otherwise unavailable (e.g., due to hazardous weather conditions such as hurricanes, earthquakes, etc.). As such, tasks and services (e.g., postal services) requiring the use of office facilities may be disrupted. Accordingly, aspects of the present disclosure may include a portable workstation apparatus that may be easily transported, stored, assembled, and used at any time and location (e.g., in situations in which office facilities may be unavailable). As described herein, the portable workstation apparatus, in accordance with aspects of the present disclosure, may include a variety of adjustable, customizable, and adaptive features to adapt the apparatus for suitable use for a wide variety of tasks (e.g., document and/or mail sorting, office type work, arts/craft work, computer/laptop work, etc.). For example, the portable workstation apparatus may include a height-adjustable desk area, one or more height-adjustable shelving units, and/or sorting components. Further, the portable workstation apparatus may include a set of foldable or collapsible legs for compact storage and transportation. That is, the portable workstation apparatus may include removable and collapsible components such that the portable workstation apparatus may be easily transported and assembled in any location. In this way, the portable workstation apparatus may be adapted for use in a variety of locations for a variety of tasks for different users' ergonomic preferences (e.g., in a situation in which office facilities may be unavailable).

Reference will now be made in detail to embodiments, examples of which are illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits, and networks have not been described in detail so as not to unnecessarily obscure aspects of the embodiments.

OVERVIEW OF COMPONENTS

Figure 1:
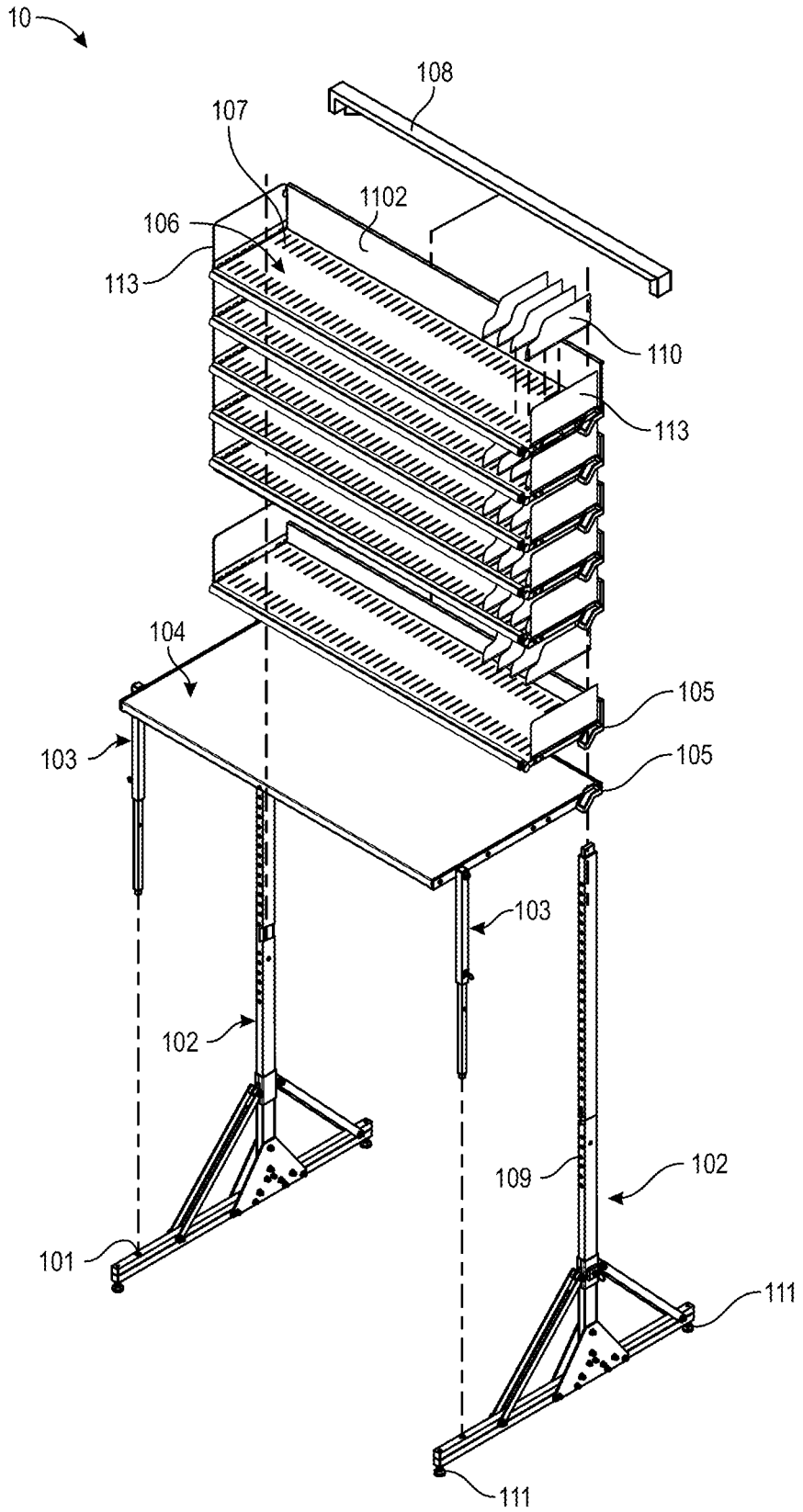
FIG. 1 shows an exploded overview of an example implementation of a portable workstation apparatus in accordance with aspects of the present disclosure.
Figure 2:
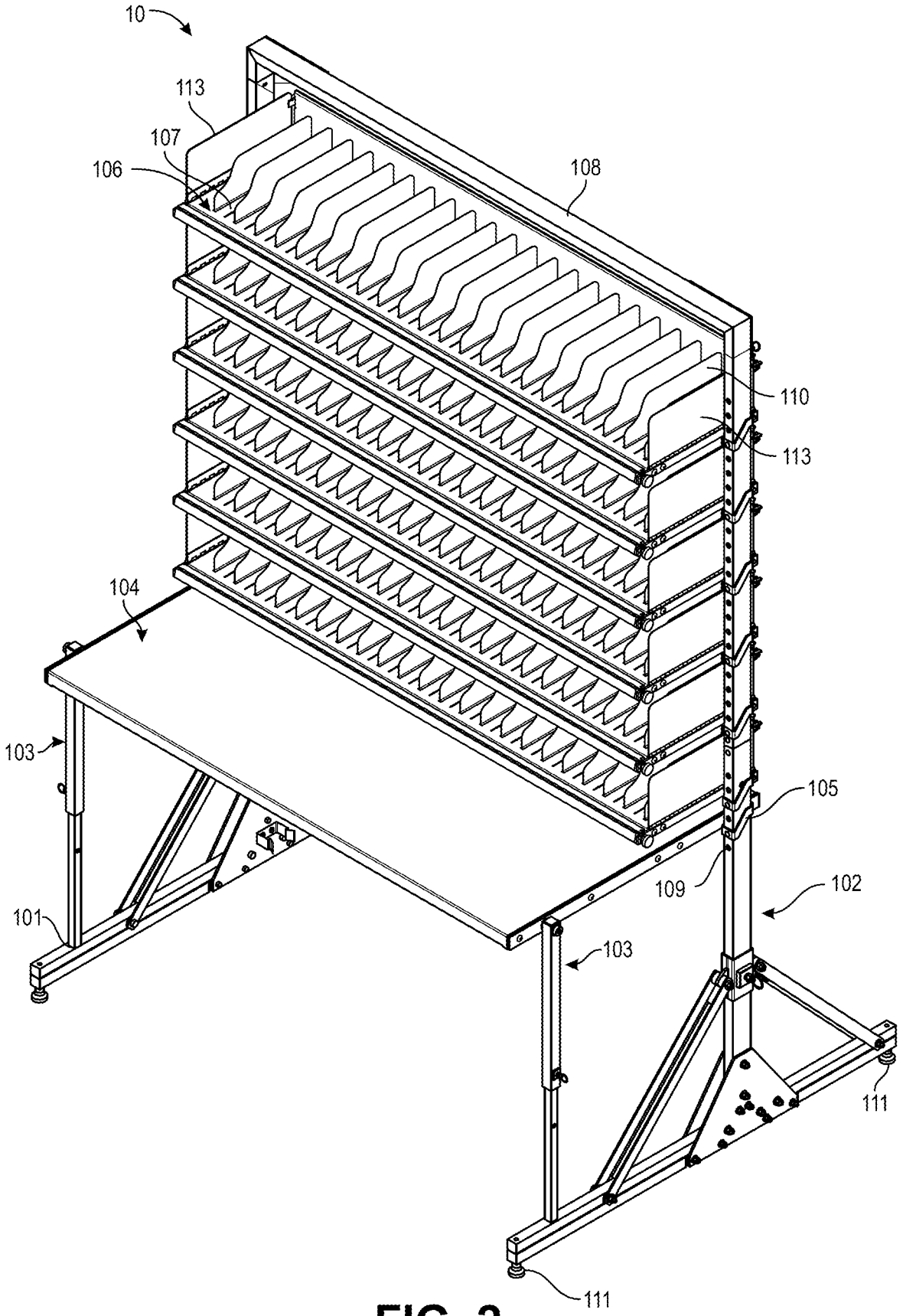
FIG. 2 illustrates a perspective front view of the portable workstation apparatus when assembled.
Figure 3:
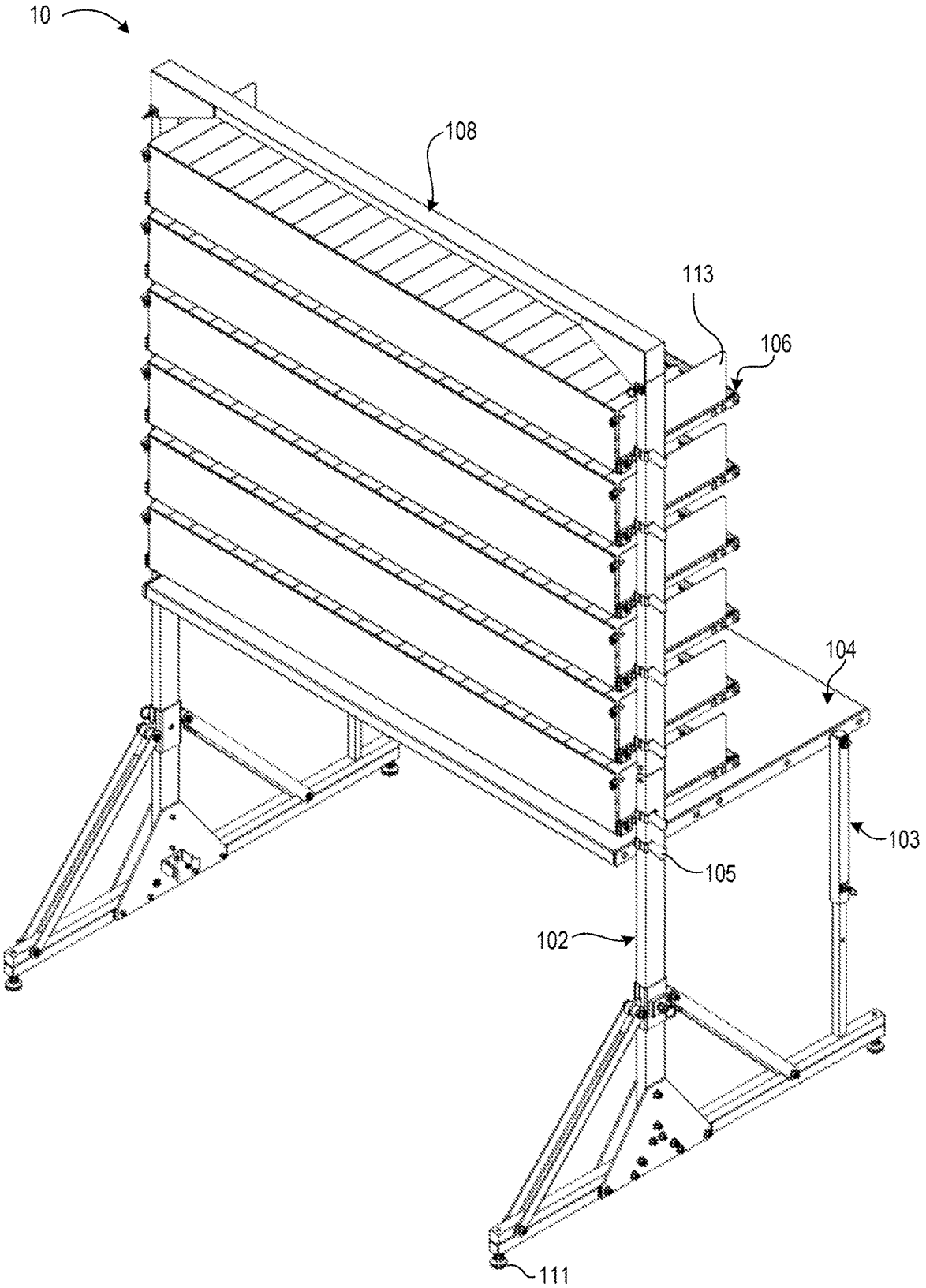
FIG. 3 illustrates a perspective rear view of the portable workstation apparatus when assembled.

FIG. 1 shows an exploded overview of an example implementation of a portable workstation apparatus in accordance with aspects of the present disclosure. As shown in FIG. 1, a portable workstation apparatus 10 may include a pair of legs 102, a desk portion 104, one or more shelves 106, and a top brace 108. As shown in FIG. 1, the desk portion 104 may include support legs 103 and brackets 105 on opposite ends, as shown. Each of the shelves 106 may include brackets 105 on opposite ends, slots 107 for receiving dividers 110, a backstop 1102 (e.g., to prevent documents and/or other items from falling behind the shelves 106), and side panels 113. The desk portion 104 may be attached to the legs 102 via the brackets 105, the shelves 106 may be attached to the legs via the brackets 105, and the top brace 108 may be attached to a top portion of the legs to provide extra stability and to retain the assembled portable workstation apparatus 10 in place. Footings 111 may be provided to stabilize and prevent slippage of the portable workstation apparatus 10 when set in place. For example, FIG. 2 illustrates a perspective front view of the portable workstation apparatus 10 when assembled, and FIG. 3 illustrates a perspective rear view of the portable workstation apparatus 10 assembled.

As described herein, the portable workstation apparatus 10 may provide a workspace in any location or situation (e.g., a situation in which a workspace may not currently exist). That is, the portable workstation apparatus 10 may provide a workspace in emergency situations in which office facilities may not be available (e.g., due to hazardous weather conditions such as hurricanes, earthquakes, etc.). As illustrative examples, the portable workstation apparatus 10 may be used for mail sorting tasks in a situation in which post office facilities are unavailable. Additionally, or alternatively, the portable workstation apparatus 10 may be used as a "hot desk" that may be set up for any variety of office work (e.g., while the user is on travel, or may otherwise desire a workspace). Since the portable workstation apparatus 10 may be easily disassembled and collapsed, the portable workstation apparatus 10 is easy to transport and store such that a workspace may be made available at any location.

Additional details of the components of the portable workstation apparatus 10, as well as assembling, disassembling, and collapsing the portable workstation apparatus 10 for compact/portable storage and transportation are described in greater detail herein.

Assembly

Figure 4A:
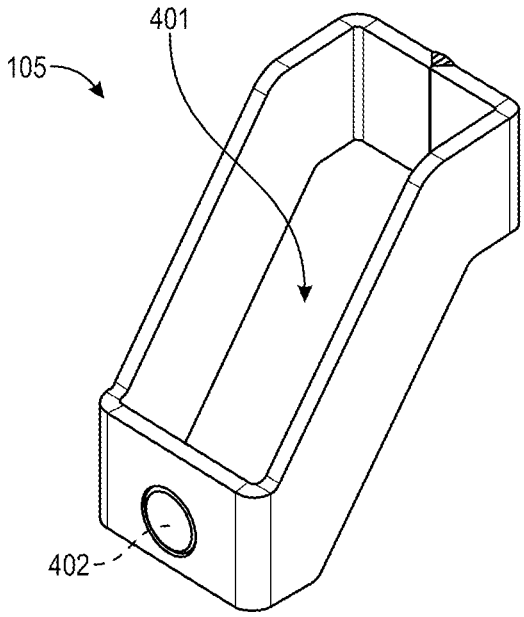
FIG. 4A illustrates a perspective view and details of a bracket used in the portable workstation apparatus.
Figure 4B:
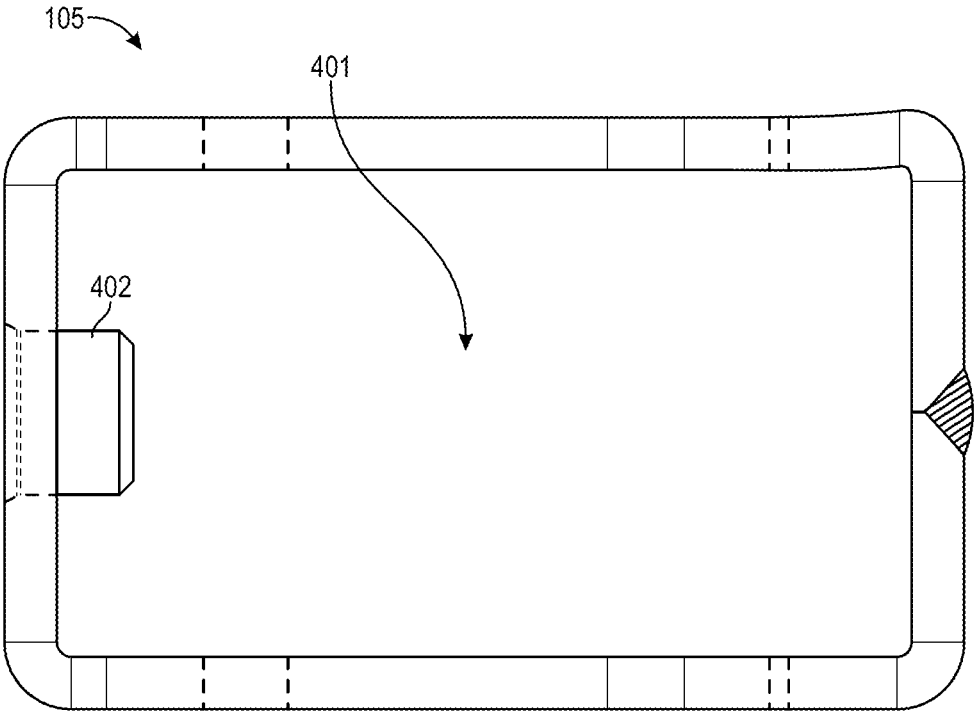
FIG. 4B illustrates a top view of the bracket shown in FIG. 4A.
Figure 4C:
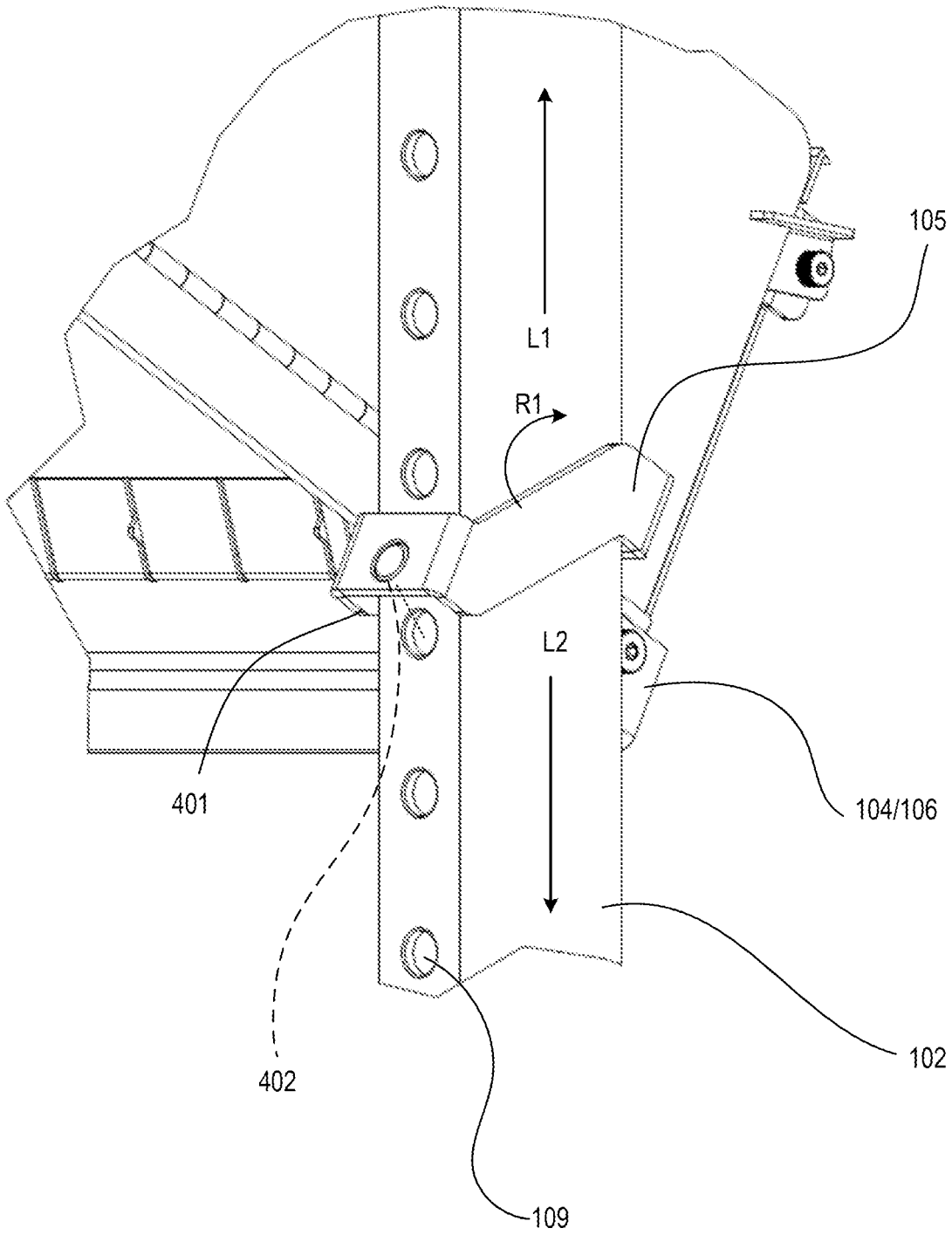
FIG. 4C and FIG. 4D illustrate installation steps for attaching a bracket into a leg of the portable workstation apparatus.
Figure 4D:
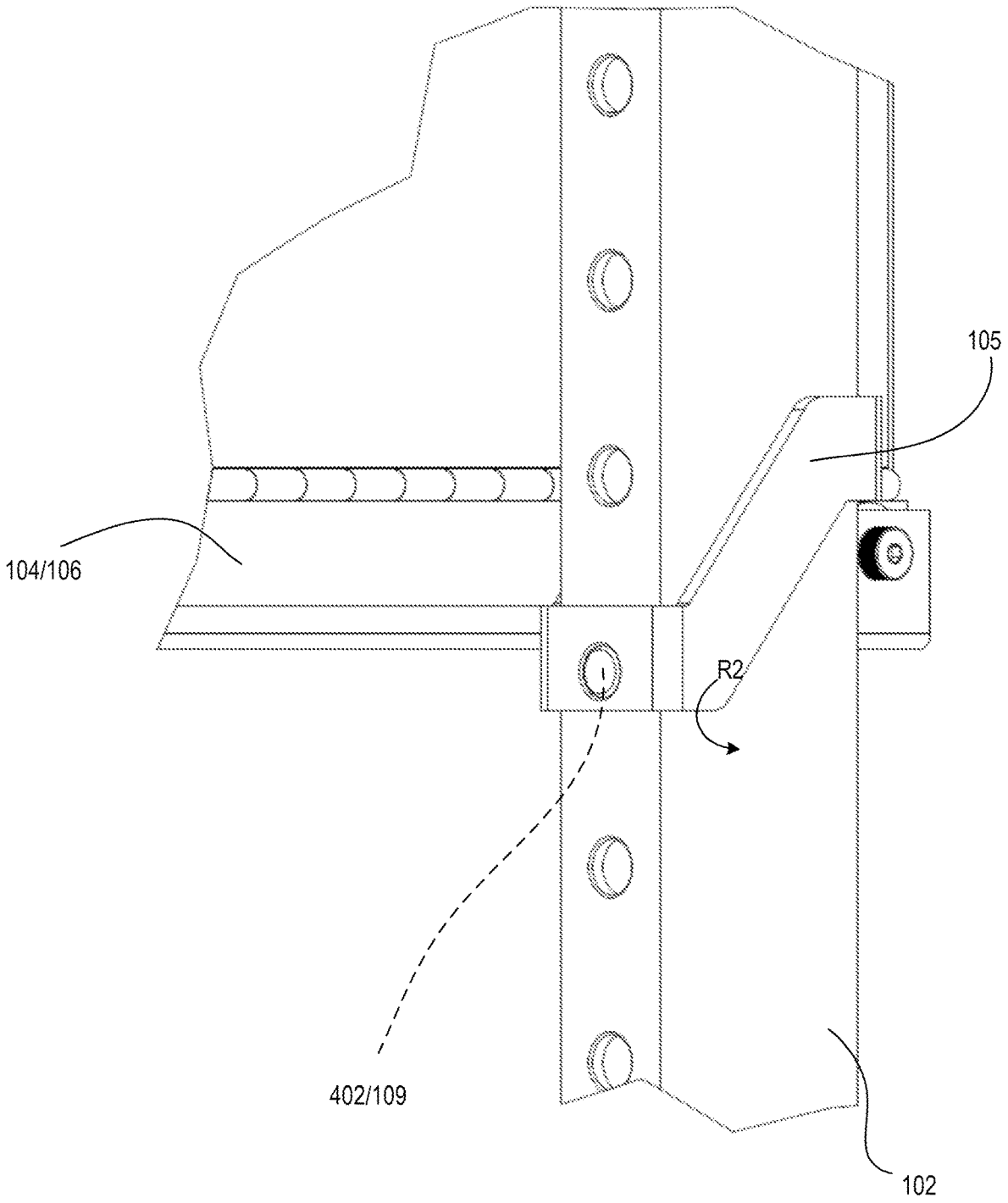

Referring back to FIG. 1, the desk portion 104 be mounted to the legs 102 via the brackets 105. For example, referring to FIGS. 4A and 4B each bracket 105 may include an opening 401 and a protruding pin 402. Each bracket 105, oriented as shown in FIG. 4C, may slide over each leg 102 through the opening 401, and the protruding pins 402 of each bracket 105 may retain the brackets 105 (and hence, the desk portion 104) to the legs 102 via the holes 109 provided in the legs 102. Referring to FIG. 4C, the brackets 105 may be oriented at an angle such that the protruding pins 402 do not engage the holes 109, thus providing clearance to allow the desk portion 104 to move freely along the legs 102. For example, the brackets 105 may be rotated (e.g., in the R1 direction as shown) such that clearance may be provided between the protruding pins 402 and the holes 109 provided in the legs 102. Once inserted, the height of the desk portion 104 with respect to the legs 102, may be slidably adjusted (e.g., by moving the desk portion 104 and hence the brackets 105 longitudinally along the legs 102 in the L1 and L2 directions). Referring to FIG. 4D, once a desired height is selected, the desk portion 104 may be attached to the legs 102 by counter-rotating the desk portion 104 (and hence the brackets 105) in the R2 direction such that the protruding pins 402 are inserted into and engage any one of the holes 109 in the legs 102. Alternatively, the brackets 105 may be counter-rotated, and slid downward or upward until the protruding pin 402 engages the hole 109.

For additional stabilization of the desk portion 104, stabilizing legs 103 may be provided and inserted into a base of the legs (e.g., at holes 101). For example, referring to FIG. 7A, the portable workstation apparatus 103 may include a telescopic post 1002, a sleeve 1004, holes 1006 at various heights, a pin 1008, and a protruding member 1010. The height of the post 1002 may be adjusted by sliding within the sleeve 1004 and retained by the pin 1008 through one of the holes 1006. In some embodiments, the height of the post 1002 may be adjusted to match the height of the desk portion 104 with respect to the legs 102.

As described herein, the shelves 106 may be mounted to the legs 102 in a similar manner as the desk portion 104. That is, the brackets 105 of the shelves 106 may oriented at an angle such that the protruding pin of the brackets 105 do not engage the holes 109 (e.g., as shown in FIG. 4C). The shelves 106 may be slidably adjusted longitudinally along the legs, and counter-rotated such that the protruding pins 402 engage the holes 109 once the shelves 106 are at the desired height and position (e.g., as shown in FIG. 4D). Once the desk 104 and the shelves 106 have been installed, the top brace 108 may be installed to connect the legs and provide additional stabilization. In some embodiments, the dividers 110 may be installed, if desired, into the shelves 106 by inserting the dividers 110 in the slots 107 of the shelves 106. As shown in FIG. 1, any number of slots 107 may be provided at various position such that the position of the dividers 110 on the shelves 106 may be adjusted.

A front perspective view of the assembled portable workstation apparatus 10 is illustrated in FIG. 2. In the example of FIG. 2, dividers 110 may be installed as shown, however, in practice, fewer dividers 110 and/or different arranged dividers 110 may be installed as desired. FIG. 3 illustrates a rear perspective view of the assembled portable workstation apparatus 10.

Disassembly and Collapsing

Figure 5:
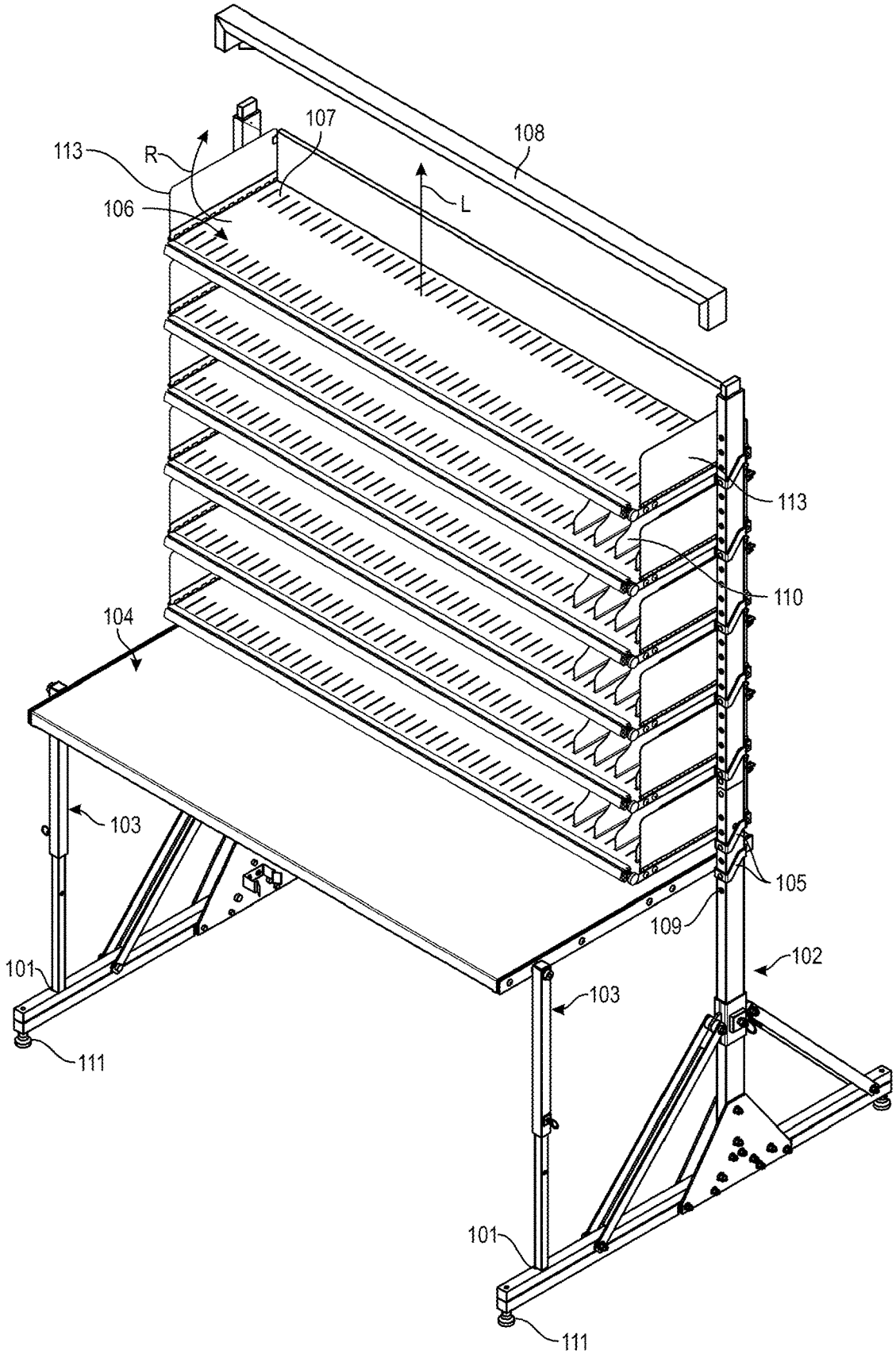
FIG. 5 illustrates removal of a top brace as part of dissembling the portable workstation apparatus.

In general, disassembly may involve reversing the assembly steps. More specifically, referring to FIG. 5, top brace 108 may be removed by lifting the top brace 108 in the L direction, as shown. The dividers 110 may be removed from the slots 107 by lifting upward in the L direction. In some embodiments, each shelf 106 may be removed by rotating the shelf 106 in the R direction as shown such that the protruding pins 402 disengage the holes 109 and lifting each of the shelf 106 in the L direction as shown in FIG. 5.

Figure 6:
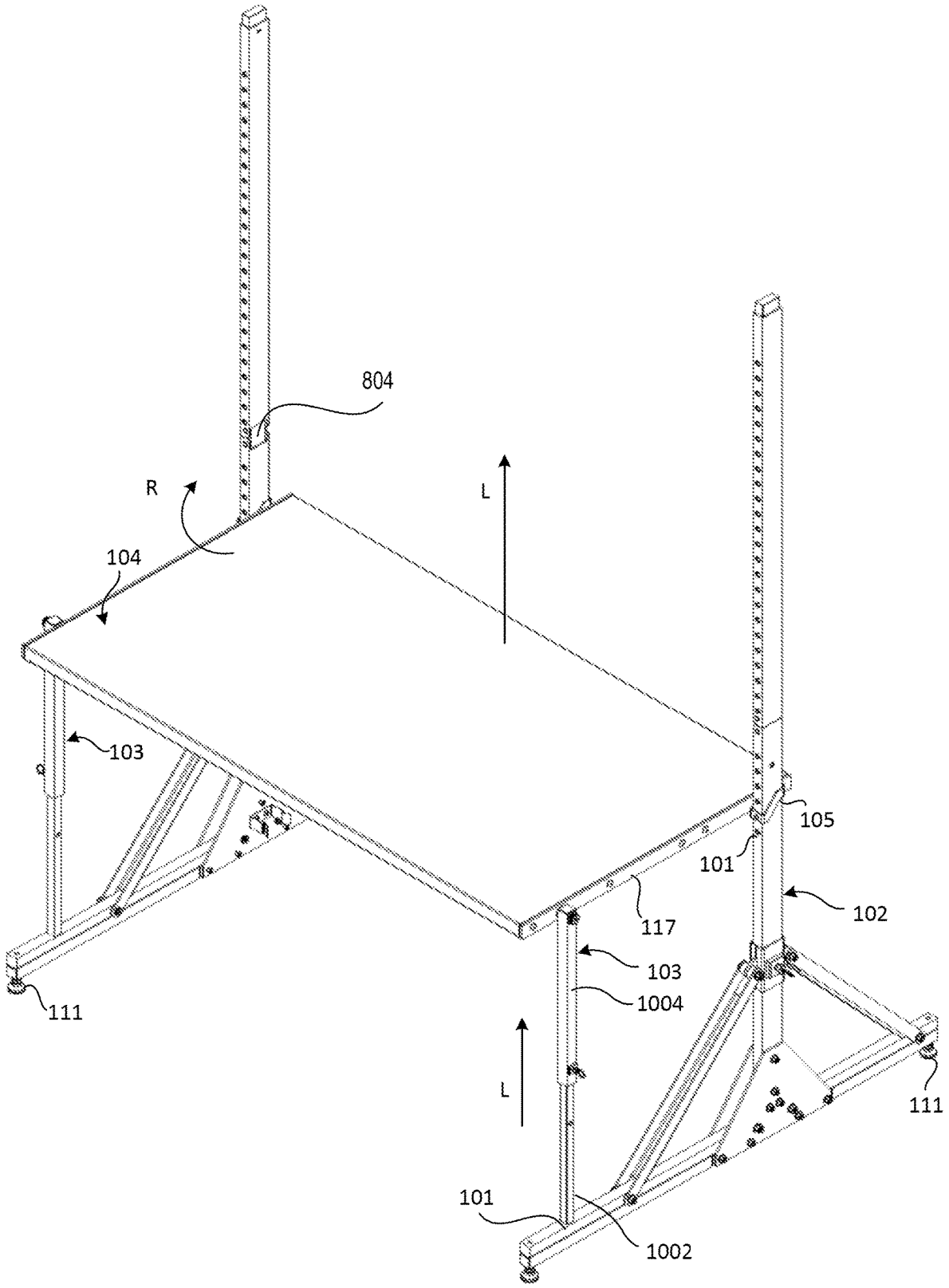
FIG. 6 illustrates removal of a desk portion as part of dissembling the portable workstation apparatus.

FIG. 6 illustrates the portable workstation apparatus 10 with all shelves 106 removed. With continued reference to FIG. 6, disassembly of the portable workstation apparatus 10 may further include removing the desk portion 104 by disengaging the posts 1002 of the stabilizing legs 103 from the holes 101. For example, referring to FIG. 7A, the post 1002 may be disengaged from hole 101 by extending the pin 1008 so as to disengage hole 1006 and sliding the post 1002 into the sleeve 1004 (e.g., in the D direction). Returning to FIG. 6, once the posts 1002 have been disengaged from the holes 101, the desk portion 104 may be removed by rotating the desk portion 104 in the R direction (e.g., thereby disengaging the protruding pins 402 from the holes 109) and lifting the desk portion upwards in the L direction until the desk portion clears the legs 102.

Figure 7A:
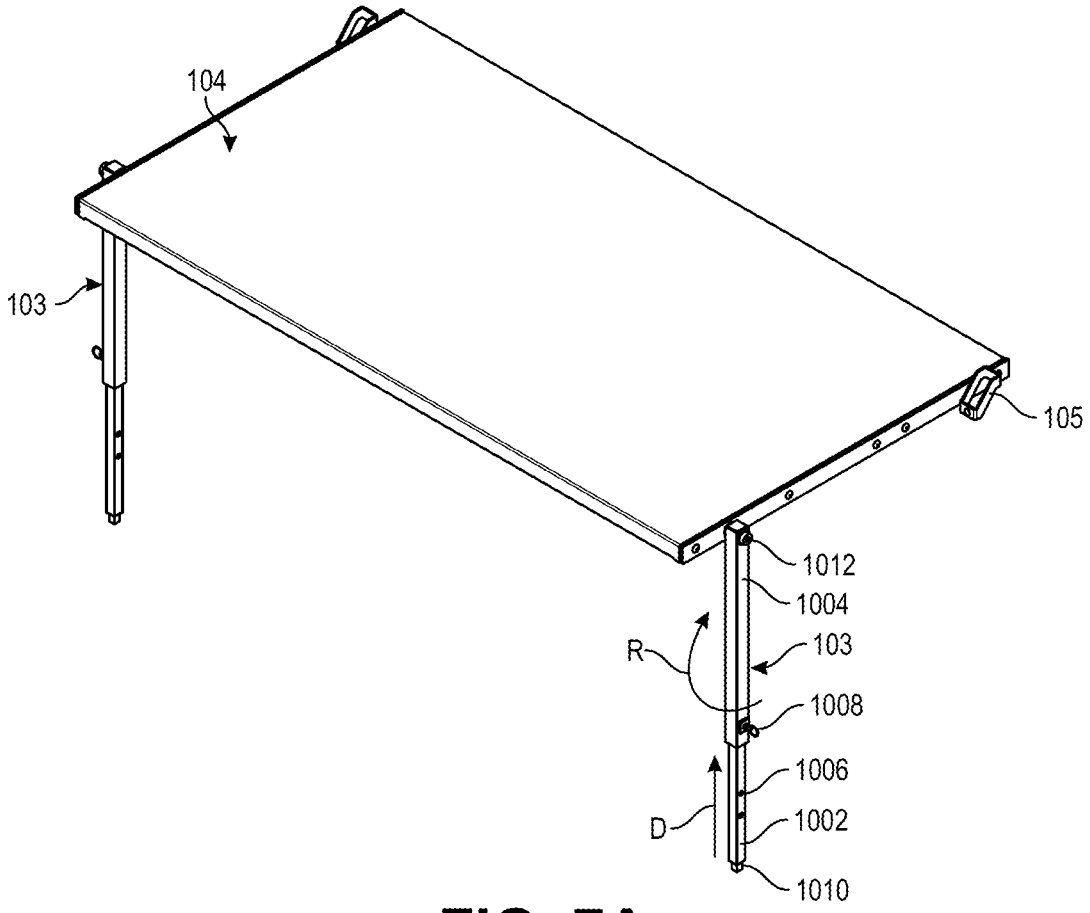
FIGS. 7A and 7B illustrate collapsing the desk portion as part of dissembling the portable workstation apparatus.
Figure 7B:
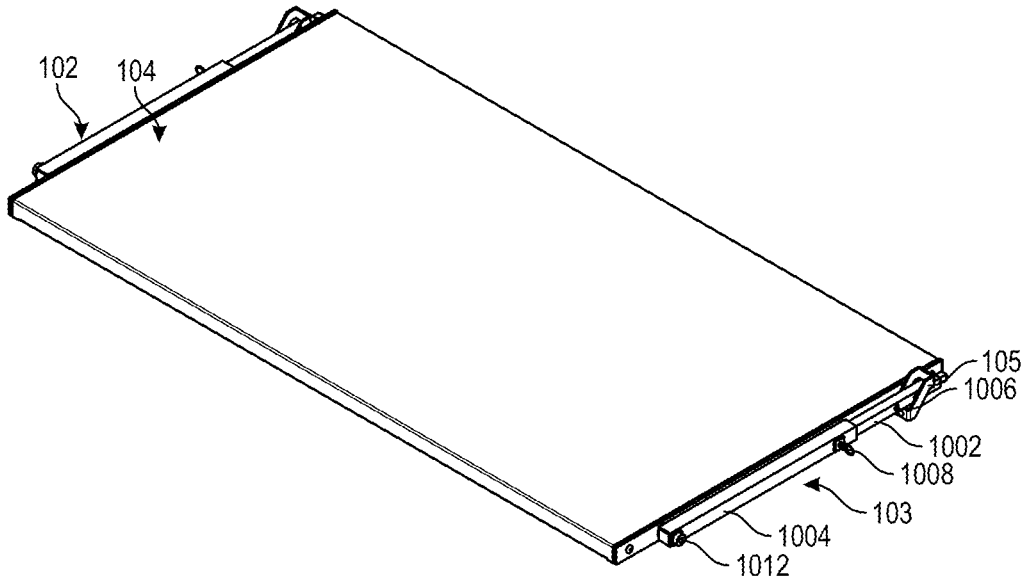

Referring to FIG. 7A, once the desk portion 104 is removed, each portable workstation apparatus 103 may be collapsed by rotating the portable workstation apparatus 103 (e.g., in the R direction about pin 1012) until the post 1002 engages and rests on the bracket 105 (e.g., as shown in FIG. 7B).

Figure 8A:
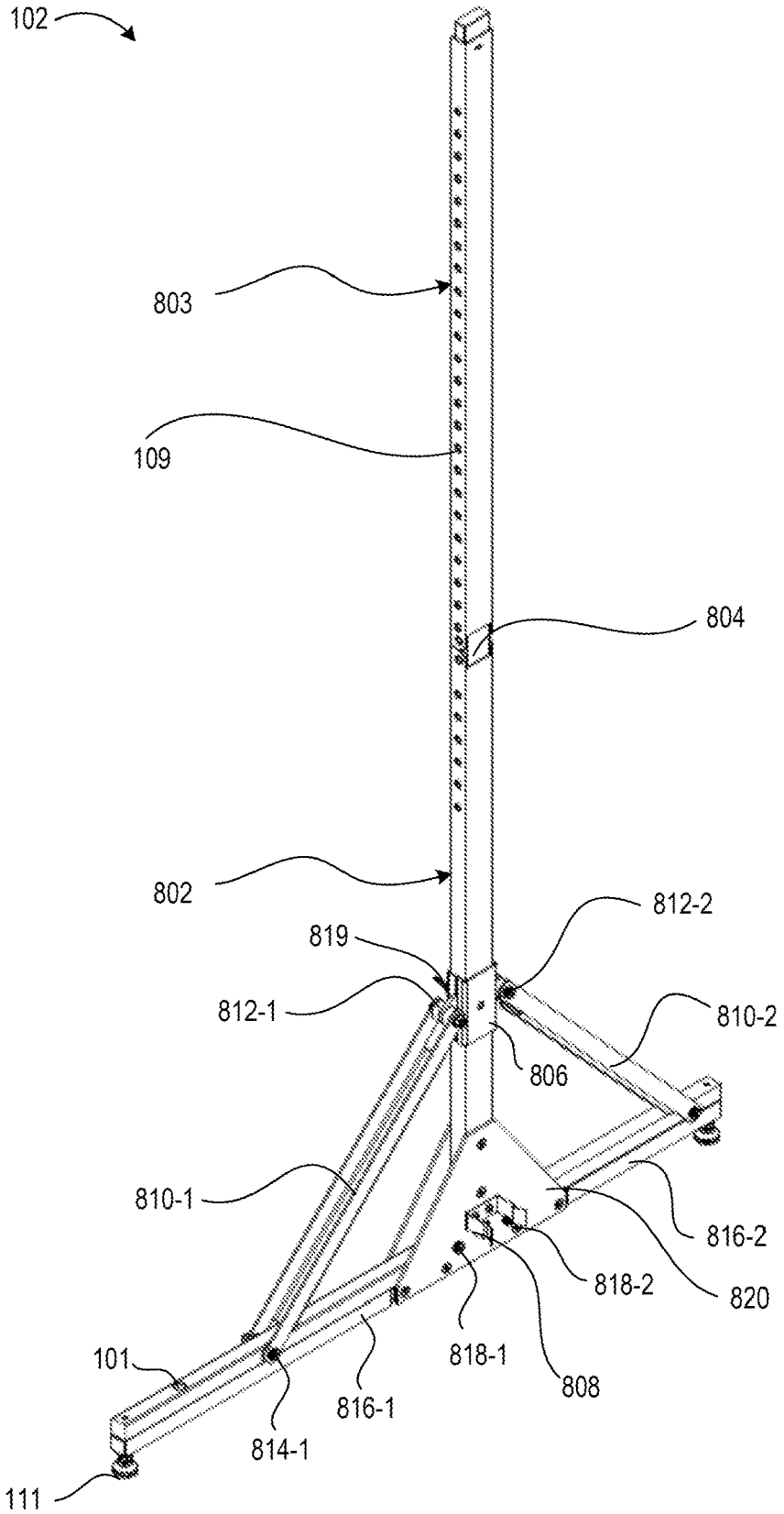
FIG. 8A illustrate a perspective view and details of a leg assembly portion of the portable workstation apparatus.

Disassembly may further include collapsing each leg 102. As described herein, each leg 102 may include components used to compactly collapse the leg 102 for storage and transport. For example, referring to FIG. 8A each leg 102 may include a lower post 802, an upper post 803, a hinge 804, a sleeve 806, a post retaining clip 808, braces 810-1 and 810-2, pins 812-1 and 812-2, pins 814, extensions 816-1 and 816-2, pins 818-1 and 818-2, and a frame 820. As further shown in FIG. 8A, first ends of each extensions 816-1 and 816-2 to connect to the frame via pins 818-1 and 818-2, respectively. Second ends of each extensions 816-1 and 816-2 may connect to the sleeve 806 via pins 812-1 and 812-2, respectively. First ends of the braces 810-1 and 810-2 may connect, respectively to the extensions 816-1 and 816-2 via the pins 814-1 and 814-2. Second ends of the braces 810-1 and 810-2 may connect, respectively, to the sleeve 806 via the pins 812-1 and 812-2. The lower post 802 may be provided within the sleeve 806. The lower post 802 and the upper post 803 may be joined via the hinge 804.

Figure 8B:
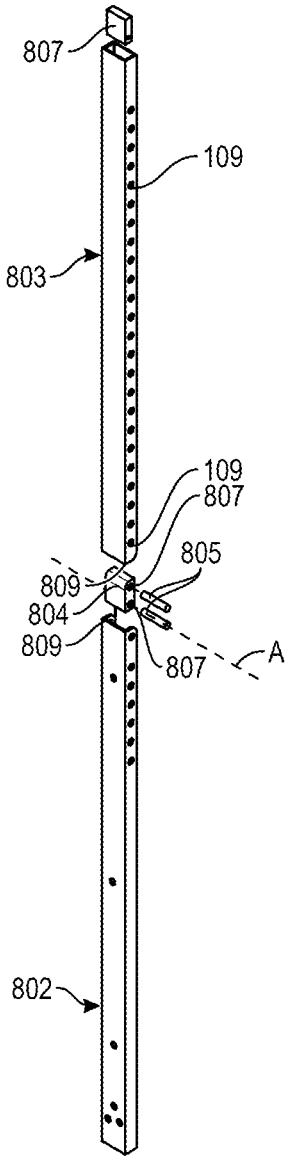
FIG. 8B illustrates an exploded view of a portion of the leg assembly of FIG. 8A.
Figure 8C:
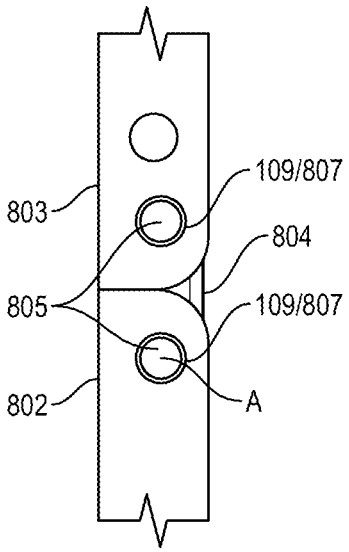
FIG. 8C illustrates a front view having details of a hinge used in the leg assembly of FIG. 8A.

Referring to FIG. 8B, the hinge 804 may connect the lower post 802 and the upper post 803. Specifically, the hinge 804 may be placed in recesses 809 provided in the lower post 802 and the upper post 803. Pins 805 may be provided through holes 109 and holes 807 within the hinge 804 to join the hinge 804 to the lower post 802 and the upper post 803. The pins may be mounted within the holes 809 and 109 such that the hinge may rotate about an axis-A. FIG. 8C illustrates a close-up of the hinge 804 connecting the lower post 802 to the upper post 803.

Figure 9:
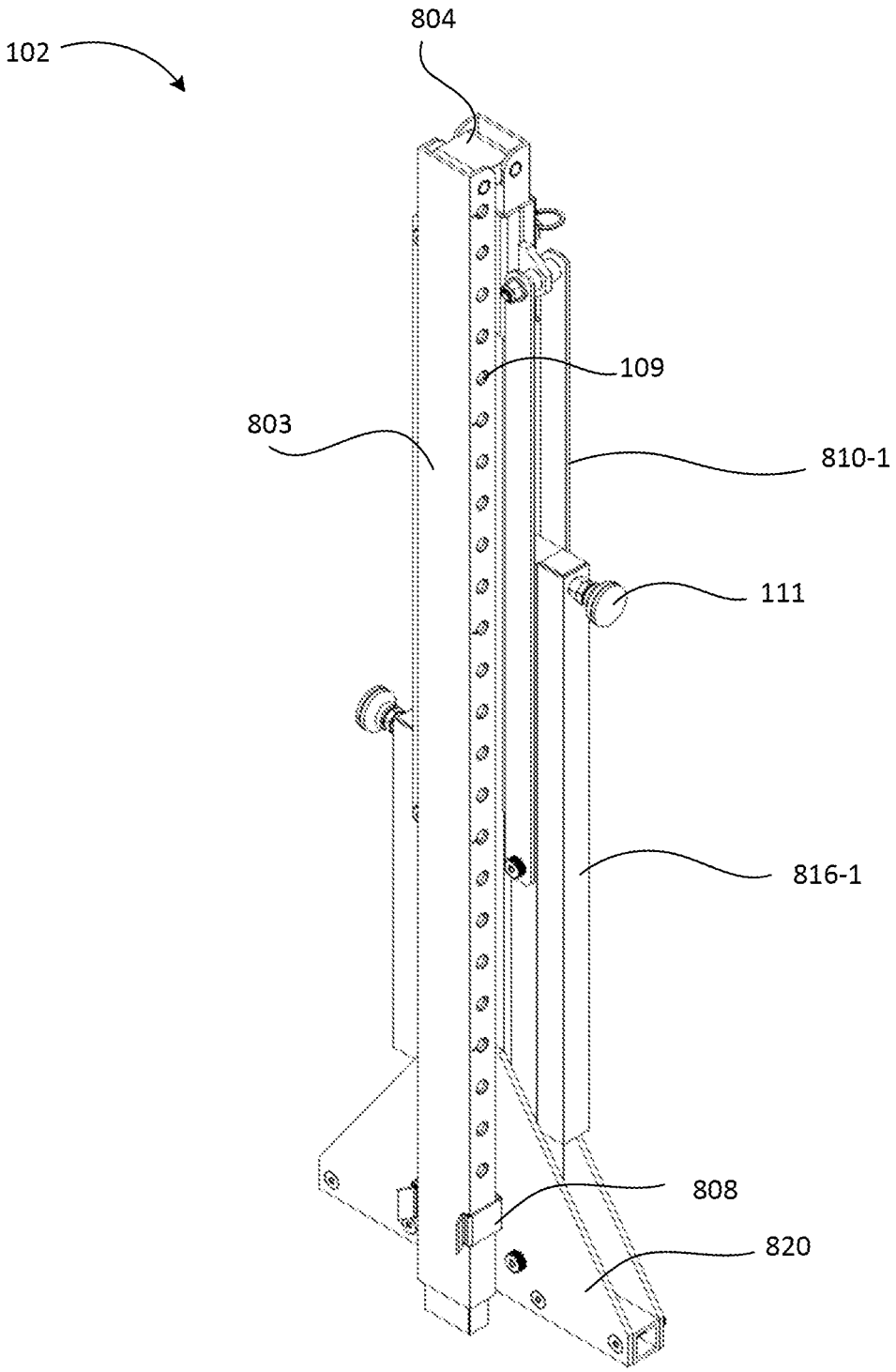
FIG. 9 illustrates the leg assembly of FIG. 8A after being collapsed.

The leg 102 may be collapsed by rotating the extension 816-1 about the pin 818-1, and rotating the extension 816-2 about the pin 818-2, thereby collapsing the braces 810-1 and 810-2 inwardly and driving the sleeve 806 onto the post 802. Further, a top portion of the post 803 may be rotated about the hinge 804 about axis A until a distal end of the post 803 engages the post retaining clip 808. FIG. 9 illustrates the leg 102 after being collapsed in accordance with the above description.

Figure 10:
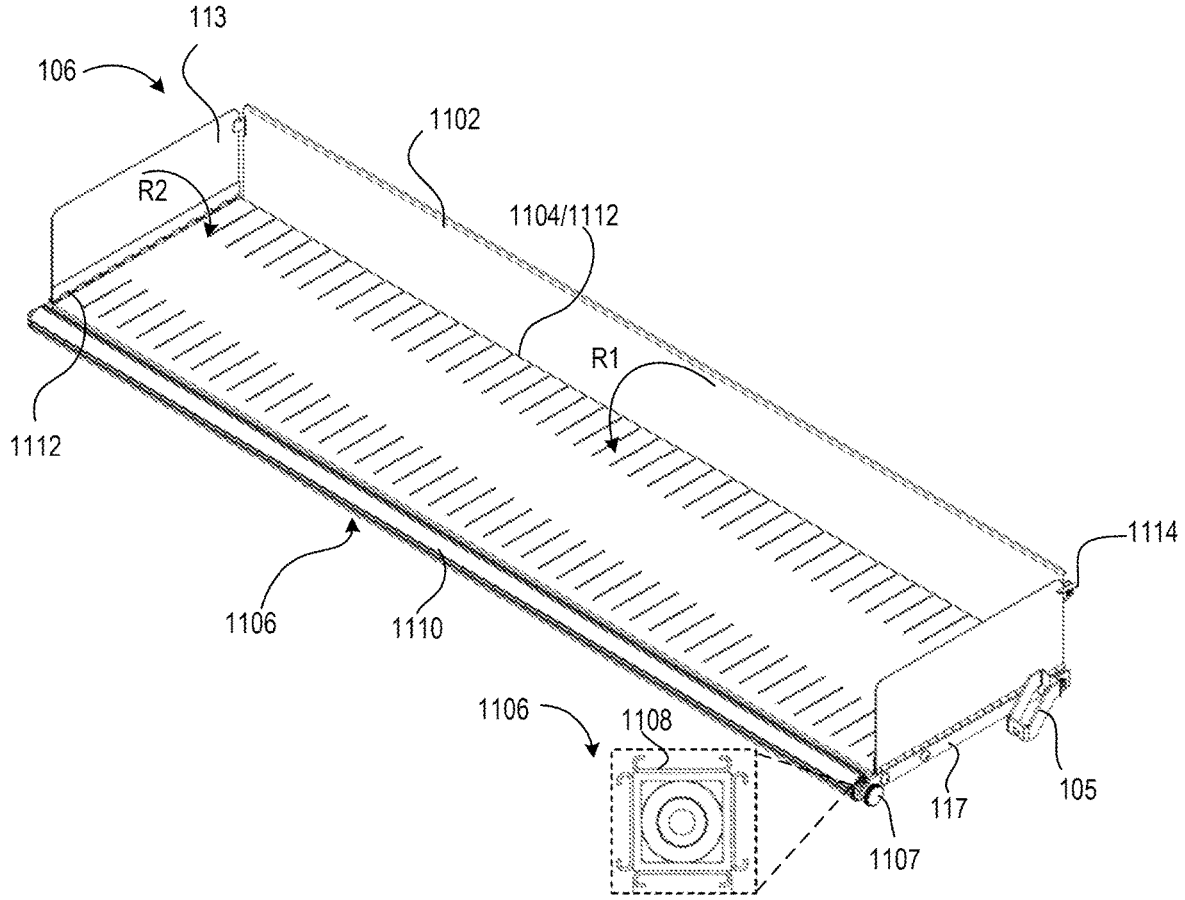
FIG. 10 illustrates a perspective view and details of a shelf used as part of the portable workstation apparatus.
Figure 11:
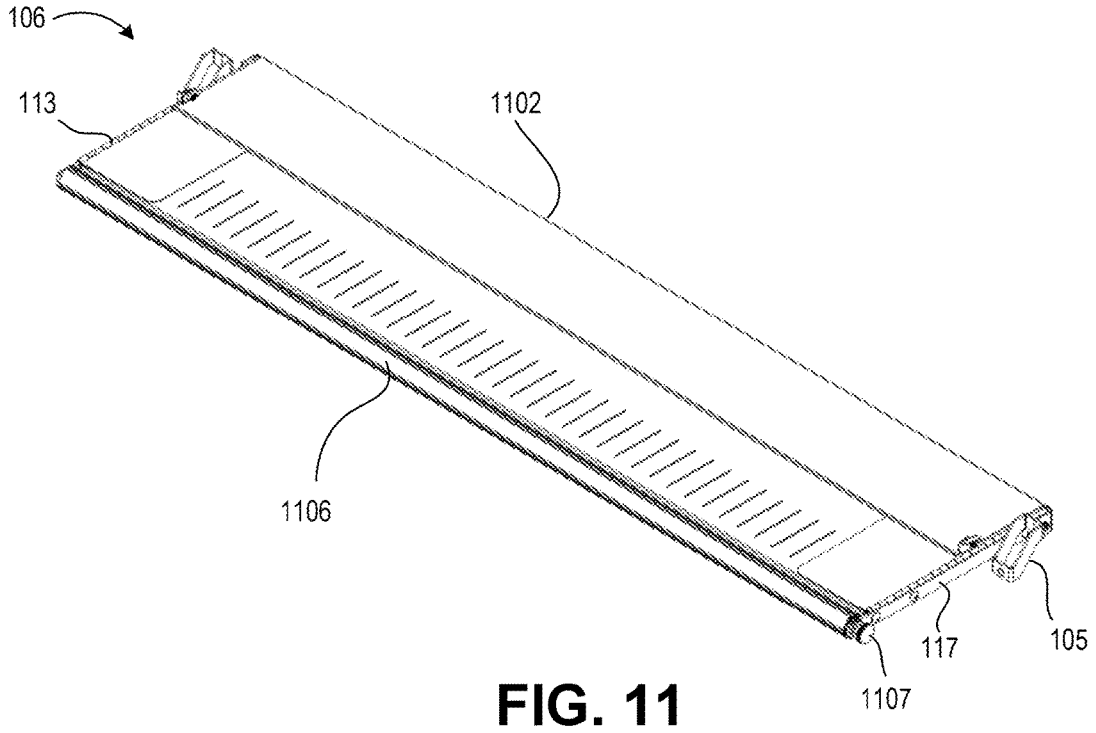
FIG. 11 illustrates a perspective view and details of a shelf used as part of the portable workstation apparatus.

FIG. 10 illustrates details for collapsing the shelf 106 in accordance with aspects of the present disclosure. As shown in FIG. 10, the shelf 106 may include a backstop 1102 (e.g., to prevent documents or items from falling behind the shelf 106), and side panels 113. In some embodiments, the backstop 1102 may be folded to compact the shelf 106 for compact transport and storage. For example, the backstop 1102 may be rotated in the R1 direction and collapsed (e.g., as shown in FIG. 11). In some embodiments, the backstop 1102 may collapsed via a hinge 1112 in which the backstop 1102 may be rotated about the hinge to collapse the backstop 1102 towards the shelf 106. Additionally, or alternatively, the backstop 1102 may be made of a flexible material such that the backstop 1102 may be folded along a spine 1104 of the backstop 1102. In some embodiments, the side panel 113 may be held in place by a retaining member 1114. Similarly, each side panel 113 may be rotated in the R2 direction to about a hinge 1112 to collapse each side panel 113 towards the shelf 106. FIG. 11 illustrates an isometric view of the shelf 106 with the side panels 113 and the backstop 1102 collapsed for compact transportation and storage. As further shown in FIG. 10, the shelf 106 may include a label holder 1106 attached to an end of the shelve 106. In some embodiments, the label holder 1106 may include a knob 1107 and retaining members 1108 to retain a label on front face 1110 of the shelf 106.

Figure 12:
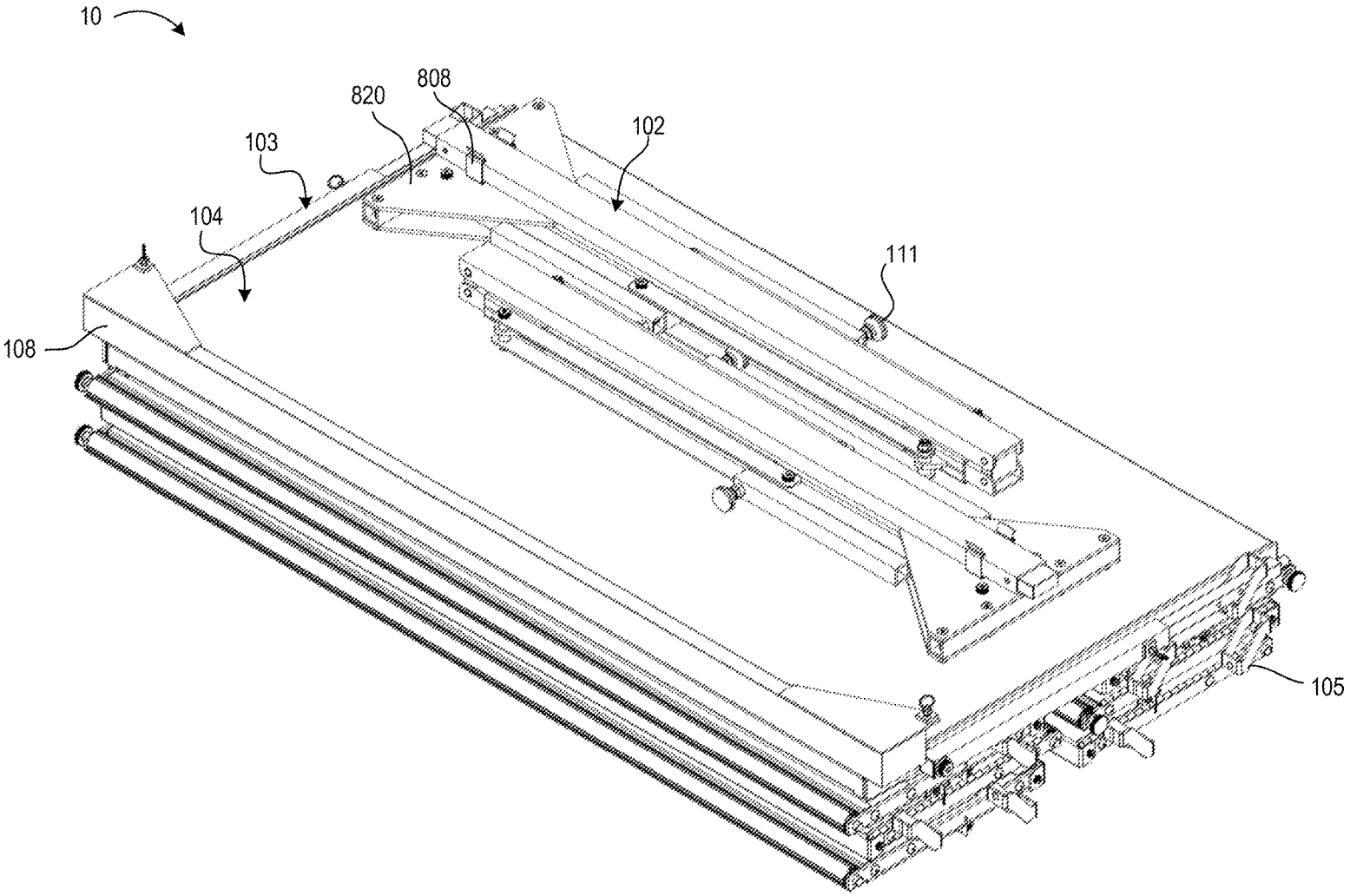
FIG. 12 illustrates a perspective view of the portable workstation apparatus after being dissembled and collapsed.

As described above, the components of the portable workstation apparatus 10 may be removed and collapsed for compact storage and travel. For example, the top brace 108, dividers 110, and shelves 106 may be removed as described above with respect to FIG. 5. The desk portion 104 may be removed and collapsed as described above with respect to FIGS. 6, 7A, and 7B. The legs 102 may be collapsed as described above with respect to FIGS. 8A, 8B, 8C, and 9. The shelves 106 may be collapsed as described above with respect to FIGS. 10 and 11. Once all the components of the portable workstation apparatus 10 have been removed and collapsed, the components may be stacked as shown in FIG. 12. In some embodiments, a carrying case, bag, and/or straps may be provided to store and transport the portable workstation apparatus 10. Once disassembled and collapse as described herein, the portable workstation apparatus 10 may be expanded and assembled for use by reversing the disassembly steps.

As described herein, the portable workstation apparatus 10 may provide a workspace in any location or situation (e.g., a situation in which a workspace may not currently exist). That is, the portable workstation apparatus 10 may provide a workspace in emergency situations in which office facilities may not be available (e.g., due to hazardous weather conditions such as hurricanes, earthquakes, etc.). As illustrative examples, the portable workstation apparatus 10 may be used for mail sorting tasks in a situation in which post office facilities are unavailable. Additionally, or alternatively, the portable workstation apparatus 10 may be used as a "hot desk" that may be set up for any variety of office work (e.g., while the user is on travel, or may otherwise desire a workspace). Since the portable workstation apparatus 10 may be easily disassembled and collapsed, the portable workstation apparatus 10 is easy to transport and store such that a workspace may be made available at any location.

The foregoing description provides illustration and description, but is not intended to be exhaustive or to limit the possible implementations to the precise form disclosed. Modifications and variations are possible in light of the above disclosure or may be acquired from practice of the implementations.

Even though particular combinations of features are recited in the claims and/or disclosed in the specification, these combinations are not intended to limit the disclosure of the possible implementations. In fact, many of these features may be combined in ways not specifically recited in the claims and/or disclosed in the specification. Although each dependent claim listed below may directly depend on only one other claim, the disclosure of the possible implementations includes each dependent claim in combination with every other claim in the claim set.

While the present disclosure has been disclosed with respect to a limited number of embodiments, those skilled in the art, having the benefit of this disclosure, will appreciate numerous modifications and variations there from. For example, some components, described as being separate pieces or parts, may be integrated into one component. Similarly, one component may be divided into one or more sub-components, pieces, or parts. It is intended that the appended claims cover such modifications and variations as fall within the true spirit and scope of the disclosure.

No element, act, or instruction used in the present application should be construed as critical or essential unless explicitly described as such. Also, as used herein, the article "a" is intended to include one or more items and may be used interchangeably with "one or more." Where only one item is intended, the term "one" or similar language is used.

What is claimed is:

1. A portable workstation apparatus comprising:

a pair of collapsible legs, each leg of the pair of collapsible legs comprising:

a frame;

an extension connected to a first end of the frame;

a lower post housed within a sleeve;

an upper post;

a hinge connecting the lower post and the upper post;

a first brace connecting the extension to the sleeve; and a plurality of holes on an exterior face of the lower post or the upper post, wherein each leg is configured to collapse by folding the upper post towards the lower post via the hinge, and rotating the extension toward the lower post, and a work portion that is attached in a removable manner to the pair of collapsible lags via a pair of brackets.

2. The apparatus of claim 1, wherein the work portion is height-adjustable.

3. The apparatus of claim 1, wherein the work portion is a desk portion.

4. The apparatus of claim 1, further comprising one or more shelves configured to be attached to the pair of collapsible legs and configured to be removed from the pair of collapsible legs.

5. The apparatus of claim 4, further comprising one or more dividers configured to be installed within respective slots in the shelves.

6. The apparatus of claim 1, wherein the sleeve is configured to slide onto the lower post when the extension is rotated towards the lower post.

7. The apparatus of claim 1, wherein the hinge connects the lower post to the upper post via pins and wherein the hinge is provided within a recess of the lower post and a recess of the upper post.

8. The apparatus of claim 1, wherein each bracket of the pair of brackets comprises an opening and a retaining pin configured to retain the bracket in a hole of the plurality of holes.

9. The apparatus of claim 8, wherein the retaining pin of the bracket disengages the hole when the bracket is rotated.

10. The apparatus of claim 1, wherein the frame comprises a post retaining clip configured to retain the upper post when the upper post is collapsed.

11. The apparatus of claim 1, wherein the lower post and the upper post are substantially perpendicular to the extension.

12. A collapsible leg, comprising:

a frame;

an extension connected to the frame;

a lower post housed within a sleeve;

an upper post;

a hinge connecting the lower post and the upper post; and a plurality of holes on an exterior face of the lower post or the upper post, wherein each leg is configured to collapse by folding the upper post towards the lower post via the hinge and rotating the extension toward the lower post.

13. The leg of claim 12, wherein the sleeve is configured to slide onto the lower post when the extension is rotated towards the lower post.

14. The leg of claim 12, wherein the hinge connects the lower post to the upper post via pins and wherein the hinge is provided within a recess of the lower post and a recess of the upper post.

15. The leg of claim 12, wherein the frame comprises a post retaining clip configured to retain the upper post when the upper post is collapsed.

16. The leg of claim 12, wherein the lower post and the upper post are substantially perpendicular to the extension.

17. A hinge mechanism, comprising:

a hinge body having a first end and a second end;

a first member having an axis;

a second member having an axis;

a first pin connecting the first member to the hinge body such that the hinge body is rotatable relative to the first member; and a second pin connecting the second member to the hinge body such that the hinge body is rotatable relative to the second member, wherein the first end of the hinge body extends into the first body, the second end of the hinge body extends into the second body, the axis of the first member and the axis of the second member are aligned when the hinge is in a first position, and the axis of the first member is parallel to the axis of the second member when the hinge is in a second position.

18. The mechanism of claim 17, wherein a first end edge of the first member contacts a first end edge of the second member when the hinge is in the first position.

19. The mechanism of claim 18, wherein the first end edge of the first member is separated from the first end edge of the second member when the hinge is in the second position.

20. The mechanism of claim 17, wherein a first end edge of the first member is separated from a first end edge of the second member when the hinge is in the second position.

* * * * *